US005415021A

United States Patent [19]

Folmer

[11] Patent Number: 5,415,021

[45] Date of Patent: May 16, 1995

[54] APPARATUS FOR HIGH PRESSURE HYDRAULIC FORMING OF SHEET METAL BLANKS, FLAT PATTERNS, AND PIPING

[76] Inventor: Carroll W. Folmer, 29781 Pebble Beach Dr., Sun City, Calif. 92586

[21] Appl. No.: 145,946

[22] Filed: Oct. 29, 1993

[51] Int. Cl.[6] ..... B21D 26/02

[52] U.S. Cl. ..... 72/58; 72/57; 72/60; 72/61; 72/63

[58] Field of Search ..... 72/57, 60, 63, 61, 58; 29/421.1

[56] References Cited

U.S. PATENT DOCUMENTS 2,327,177 8/1943 Cross ..... 72/60
2,348,921 5/1944 Pavlecka ..... 72/63
3,380,272 4/1968 Halter ..... 72/60

FOREIGN PATENT DOCUMENTS 0623420 7/1961 Canada ..... 72/63
0093519 6/1983 Japan ..... 72/63

*Primary Examiner*—David Jones
*Attorney, Agent, or Firm*—Charles C. Logan, II

[57] ABSTRACT

A method for augmenting an apparatus with pumps and a high pressure multiplier in such a manner that the apparatus can be altered to perform as a draw die press, hydroform press, tube bender, and as a hydraulic bulge form press by utilizing appropriate quick change platens.

5 Claims, 9 Drawing Sheets

INPUTS:

1 MAIN HYDRO SYSTEM UP TO PRESSURE
2 PRIMING HYDRO SYSTEM UP TO PRESSURE
3 PRESS-OPEN POSITION
4 PRESS-CLOSED AND LOCKED POSITION
5 SAFETY GATE CLOSED AND LOCKED
6 54 ENGAGED
7 FLOW INDICATOR
8 SAFETY GATE IS IN OPEN POSITION

OUPUTS:

SEE DEFINITON OF NOTED VALVES

INPUTS:

1. PROGRAM START
2. BALL FEEDBACK
3. CLOSE 124
4. OPEN 122
5. SET TO REQUIRED POSITION

OUTPUTS:

1. UNLOCK LOCKING SPROCKET
2. PUT IN IDLE MODE
3. BACK OFF 122 SPROCKET
4. PUT IN IDLE MODE
5. BACK OFF 124 SPROCKET
6. PUT IN IDLE MODE
7. LOCK 124
8. LOCK 122
9. SET LOCKING SPROCKETS

APPARATUS FOR HIGH PRESSURE HYDRAULIC FORMING OF SHEET METAL BLANKS, FLAT PATTERNS, AND PIPING

This invention is being submitted to use with the facility, depicted in patent application Ser. No. 08/095,109 filed on Jul. 21, 1993 for "A METHOD OF HEAT ASSISTED SHEET METAL FORMING IN 360 DEGREE SHAPES."

BACKGROUND

1. Field of Invention

This invention relates to the sheet metal forming of shapes for the aerospace and related industries.

2. Description of Prior Art

There are factories and subcontractors who produce sheet metal parts from blanks using draw dies mounted in large hydraulicly operated presses. Some form parts from the blanks using drop hammers. There are factories and subcontractors who form various flat patterns using large hydro presses. There are factories and subcontractors who manipulate and form tubing, piping and ducting using a multitude of machines to do same.

Although they have established a successful history, they suffer from some disadvantages:

They suffer from the expense of having to amortize the cost of several machines and the use of excessive factory floor space.

The standard for draw dies and drop hammer ides is to use a female die and a male punch. The material is trapped between the two and the male punch is translated forcing the material into the female die.

Drop hammers suffer from recent environmental studies that show that the lead dies emit toxic particles into the air during use.

Piping for aerospace is usually formed using expensive rollers and so called snakes to form bends in piping and ducting.

Piping that can not be formed using rollers and snakes are usually made by forming half stampings and welding the pieces together.

SUMMARY OF THE INVENTION

Accordingly, besides the objects and advantages of the forming method described in my co-pending patent application, several objects and advantages of the present invention are:

(a) Removable quick change platens are designed to transform a singular apparatus into a press to simulate a draw die operation and a drop hammer operation, to do the work of a hydro press and to manipulate, and to internally form piping to size.

(b) The draw die platen presses on a o-ring and the metal blank to hold the edges while high pressure hydraulic fluid is pumped through the platen and onto the metal sheet, forcing the sheet metal sheet to take the shape of the die eliminating the expense of one of the dies normally associated with draw dies or drop hammers. This is a high speed operation. Replacing drop hammers enhances the environment by eliminating lead dies.

(c) The hydroform platen contains a bladder made from urethane or some other tough material. Hydraulic fluid is pumped through the platen and onto the mating surface of the urethane bladder. The bladder expands causing sheet metal flat patterns to take the shape of form blocks.

(d) The piping platens are jig bored for rapid and accurate mounting to the press. Piping is secured to a seal plug located on one die half and pressurized with liquid to the yield point of the material. The dies are then translated together. The piping can be preformed by translating the dies together. The piping can be preformed by translating the dies together. If compound bending is required sequential dies can be used. When the preforming is sufficient the final shape can be obtained by internal pressure in the piping. In most cases we can eliminate half stampings and bulge form the finished shape from a singular duct.

REFERENCE NUMERALS IN DRAWINGS

14 Main Pump
16 Basic Structure
17 Structural slider
18 Safety Gate
19 Draw Bar
20 Draw Die Attach Platen
21 Draw Die Seal Bladder
22 Draw Die Pressure Plate
23 Opposing Draw Die Platen
24 Draw Die
26 O-Ring
28 Draw Die Blank
28B Draw Die Formed Shape
30 Bladder Guide 32 Hydroform Platen
34 Urethane Bladder
36 Form Block Mount Platen
38 Form Block
40 Flat Pattern
40B Hydroformed Shape
42 Form Block Tool Pin
44 Hydraulic Drain Slump
46 RH Sliding Mount Platen
48 LH Sliding Mount Platen
50 Primary Die
52 Opposing Die
54 Piping End Plug Center feed
56 Piping Mount
58 Pipe
58B Formed Piper
60 LH Hydraulic Drive Cylinder for Platen 48
62 RH Hydraulic Drive Cylinder for Platen 46
64 LH Overcenter Linkage
66 RH Overcenter Linkage
68 Low Pressure Auxillary Power Source
70 High Pressure Auxillary Power Source
72 Main Drive Cylinder
74 High Pressure Multiplier Output
76 Main Pump Reservoir
78 Hydraulic Manifold
80 Quick Disconnect Panel
80A Quick Disconnect Panel Die Positioner
82 Micro Processor
83 Pressure Control Panel
Control Valves:
84 Press Drive Cylinder Valve to close LH Side
86 Press Drive Cylinder Valve to open LH Side
88 Press Drive Cylinder Valve to close RH Side
90 Press Drive Cylinder Valve to open Rh Side
92 Forming Drive Cylinder Valve Input
94 Forming Drive Cylinder Valve Return
96 Die Set-Up Cylinder to disengage Part
98 Die Set-Up Cylinder to engage Part
100 Auxillary Power for end feeding of Part
102 Part forming shut-off valve
104 Platen Pressure Valve
Pressure Relief Valves:
106 Part forming high pressure output (Failsafe)
108 Pressure Setting for High Pressure Output
110 Main Hydro Manifold (press operation system) (Failsafe)
112 Pressure Setting for End Feeding of Part
114 Platen Stamping and/or Draw Forming Control Valve
116 High Pressure Prime of System Check Valve
118 Part Prime Control
120 Position Sprocket (B)
122 Locking Sprocket (B)
124 Position Sprocket (A)
126 Locking Sprocket (A)

DESCRIPTION OF PREFERRED EMBODIMENT

As noted earlier this is an apparatus to simulate and improve upon draw die forming, hydropress forming and manipulation and forming of piping. The changing of platens and direction of hydraulic pressure makes it possible.

Figure 1:
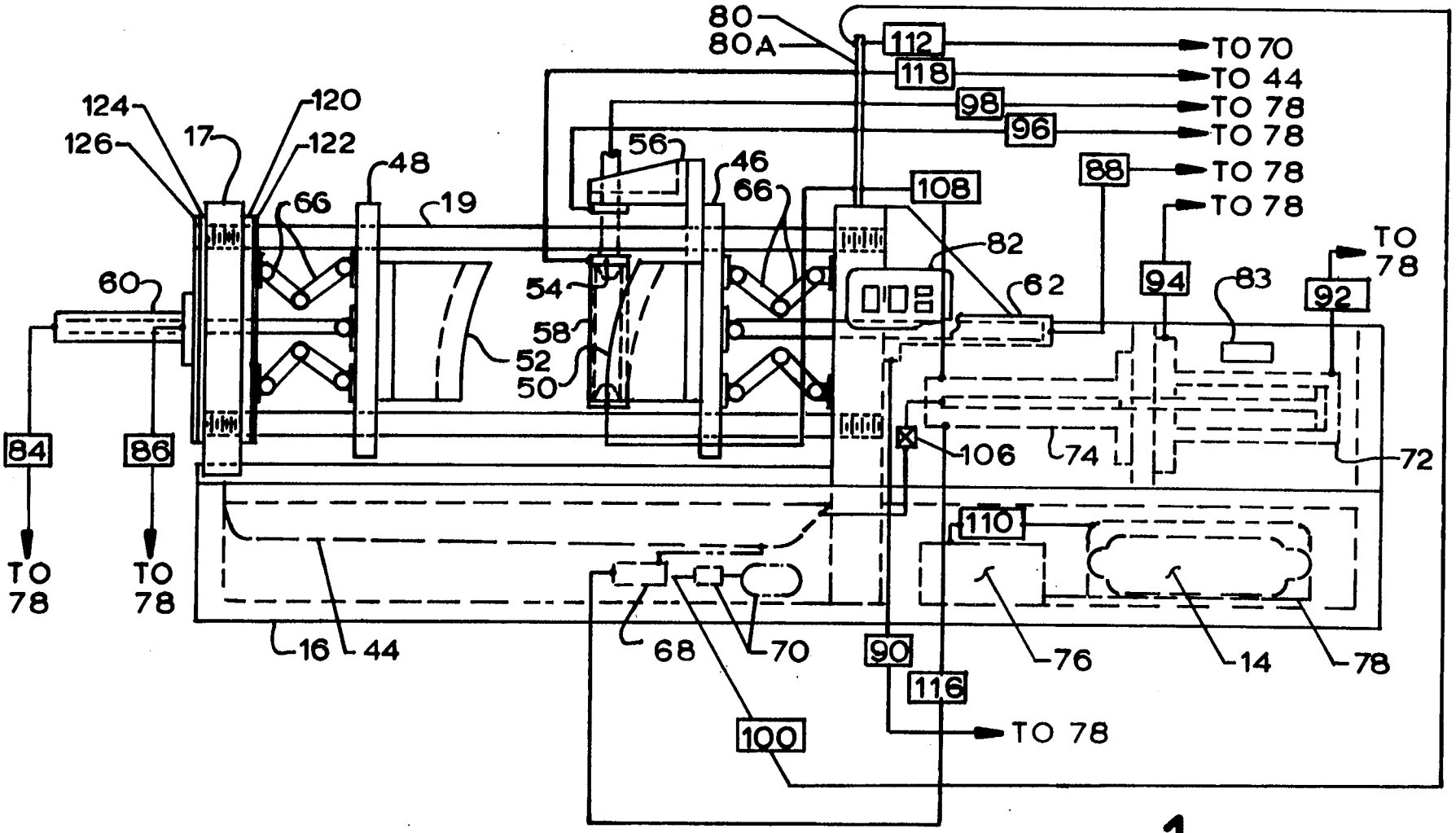
FIG. 1 shows an overall view of the facility illustrating piping dies mounted to their platens and to the press with the capability of both dies being translated.

FIG. 1 shows and overall view of the apparatus illustrating piping dies 50 and 52 mounted to their platens 46 and 48 which are driven by actuators 60 and 62 with the ability of both dies being translated. The distance between the platens is controlled by positioning sprockets 120 and 124 locked with locking sprockets 122 and 126. Overcenter linkage 64 and 66 lock the dies in the forming position. The apparatus consist of a basic structure 16 which is designed to resist all types of loading. Any part not labeled is part of the basic structure 16. The system is driven by a main pump 14 augmented with a high pressure pump 70 and a low pressure pump 68. The main pump 14 is ported through the manifold 78. Hydraulic fluid is pumped to a cylinder in the main drive cylinder 72 which in turn drives a shaft into and creating the high pressure multiplier 74. Low Pressure Fluid is provided to the multiplier 74 form the low pressure pump 68 and is valve controlled through the controller 82. High pressure pump 70 and its accumulator is provided for end feeding of the workpiece 58 when required. Fluids not returned to 70 or 78 are dumped into the hydraulic drain slump 44. All operations are controlled through the controller 82 and the quick disconnect panels 80 and 80A. Some of the schematics are illustrated with a more complete input output relationship shown in FIGS. 7, 8, and 9. A special see through gate was installed as a safety feature to keep operators from being hurt during operations.

Figure 2:
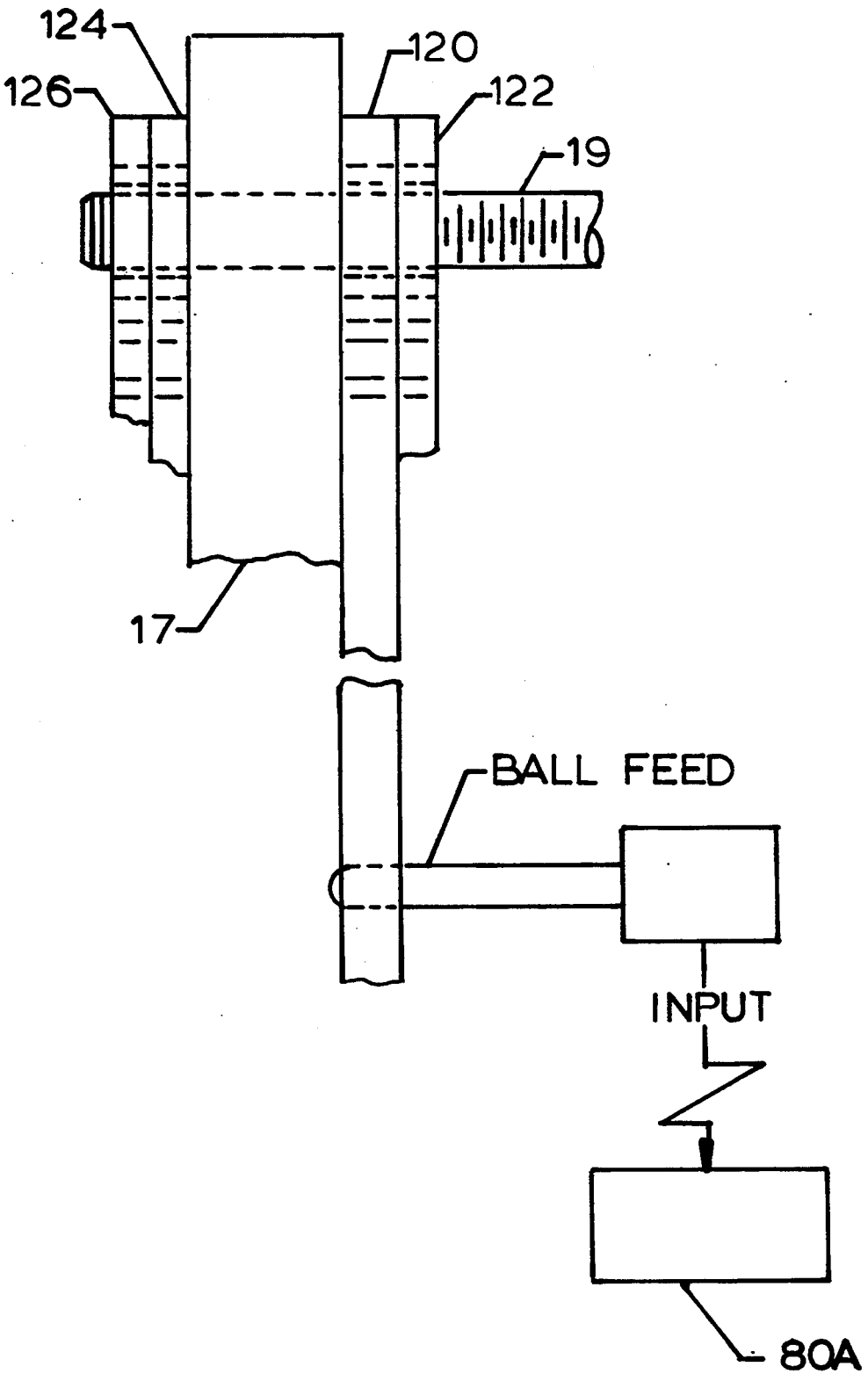
FIG. 2 is an illustration of a high speed chain driven sprocket alignment feature of the apparatus. There is a chain driven positioning sprocket on each side of the structural slider for forward or aft positioning. Once the slider is positioned all sprockets are locked including the forward and aft locking sprockets. There is a ball feed back which furnishes the positioning to the control panel 80A.

FIG. 2 is a schematic of the chain driven positioning sprockets 120 and 124 and the locking sprockets 122 and 126. The positioning sprockets move the structural slider 17 to position the distance between platens. The chain feed has a micro ball feedback that allows for input to the quick change panel 80A.

Figure 3:
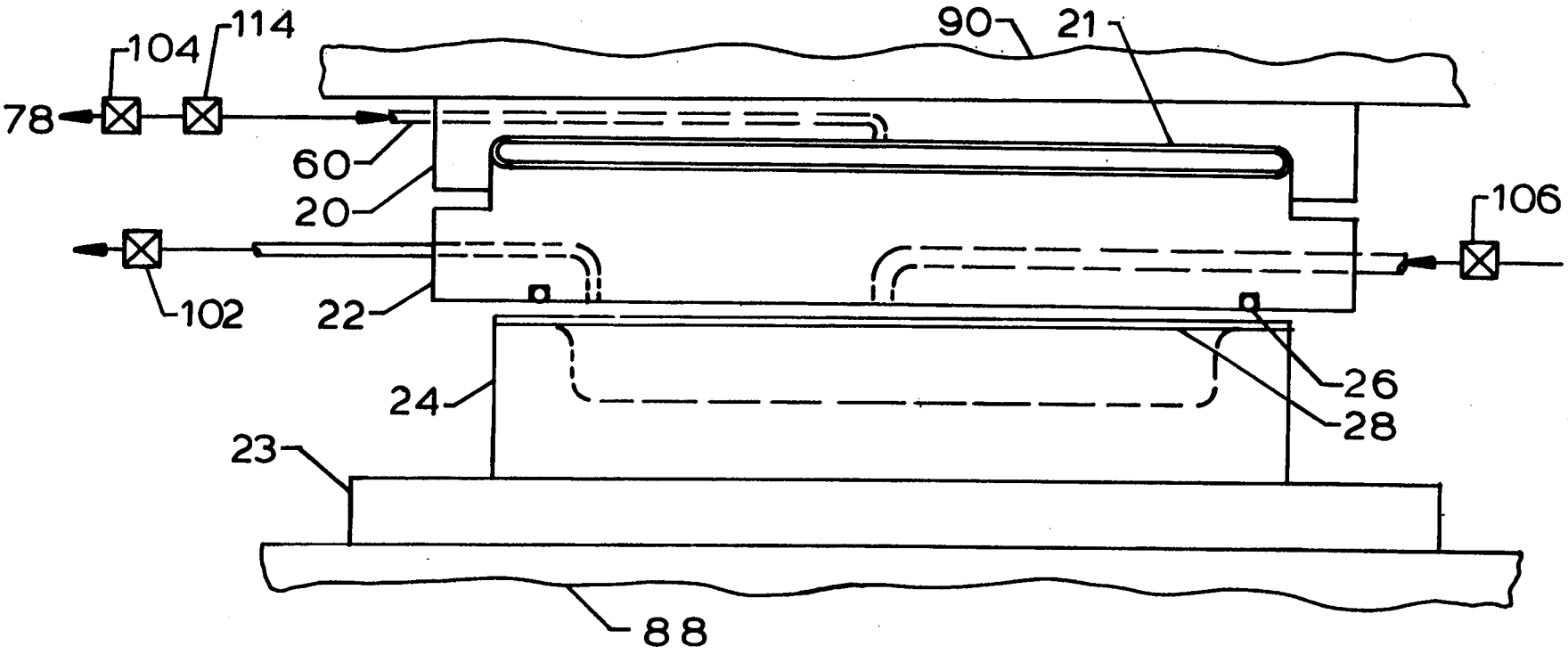
FIG. 3 illustrates the draw die process as it indicates draw die platens installed to the press in such a manner as to allow high pressure to apply appropriate pressure to the work sheet and then to provide high pressure from the hydraulic multiplier to form the shape.

FIG. 3 is an example of versatility as we convert the apparatus to simulate draw die operations. A draw die attach platen 20 is attached to platen 48. Fluid pressure is directed through the seal bladder 21 which applies pressure through the pressure platen 22 to the o-rings 26 and to the workpiece 28. High pressure can then be directed by the controller 82 form the multiplier 74 through the pressure plate 22 to the sheet metal blank 28 forcing it to take the shape of the draw die 24 which is mounted to a platen 23 mounted to platen 46.

Figure 4:
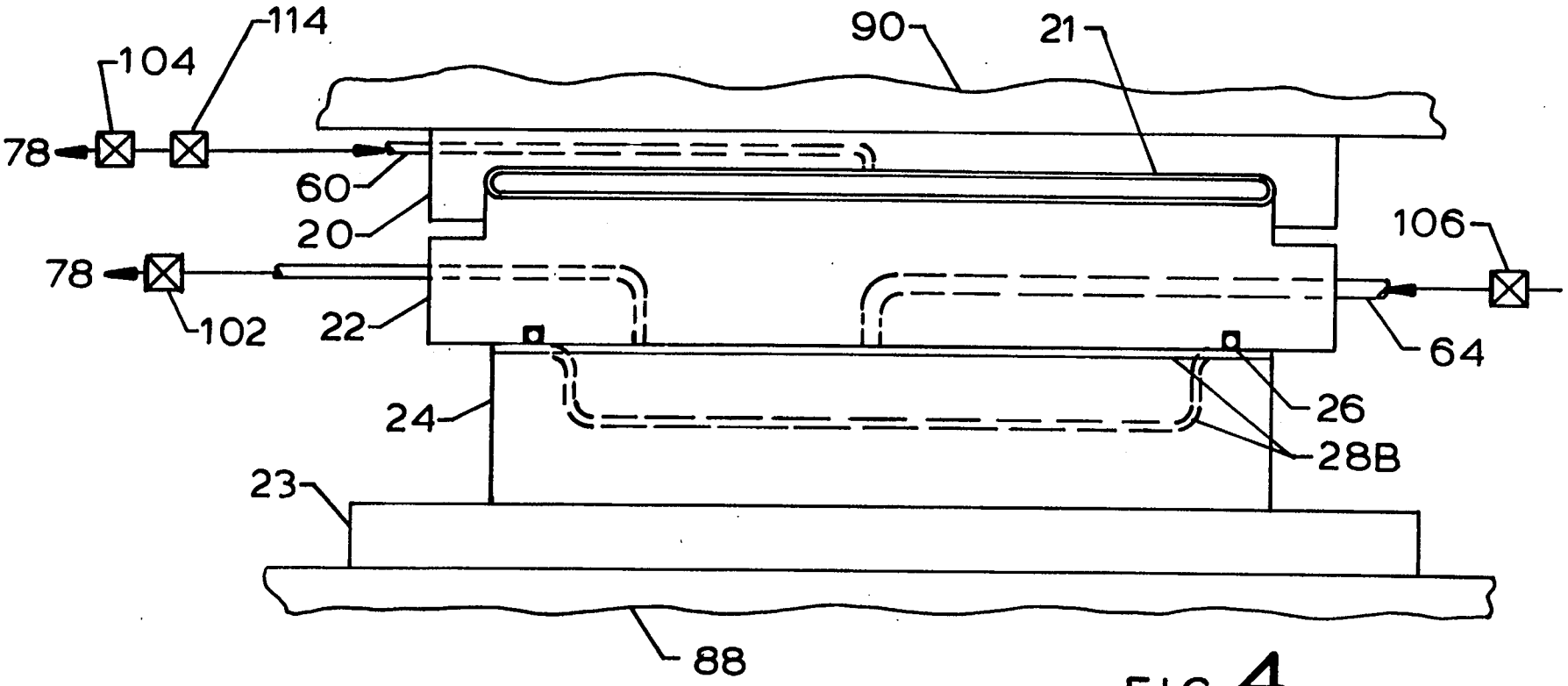
FIG. 4 is the same as FIG. 3 except it shows the sheet metal shape after forming.

FIG. 4 is the same as FIG. 3 except it shows the sheet metal shape 28B in the formed condition.

Figure 5:
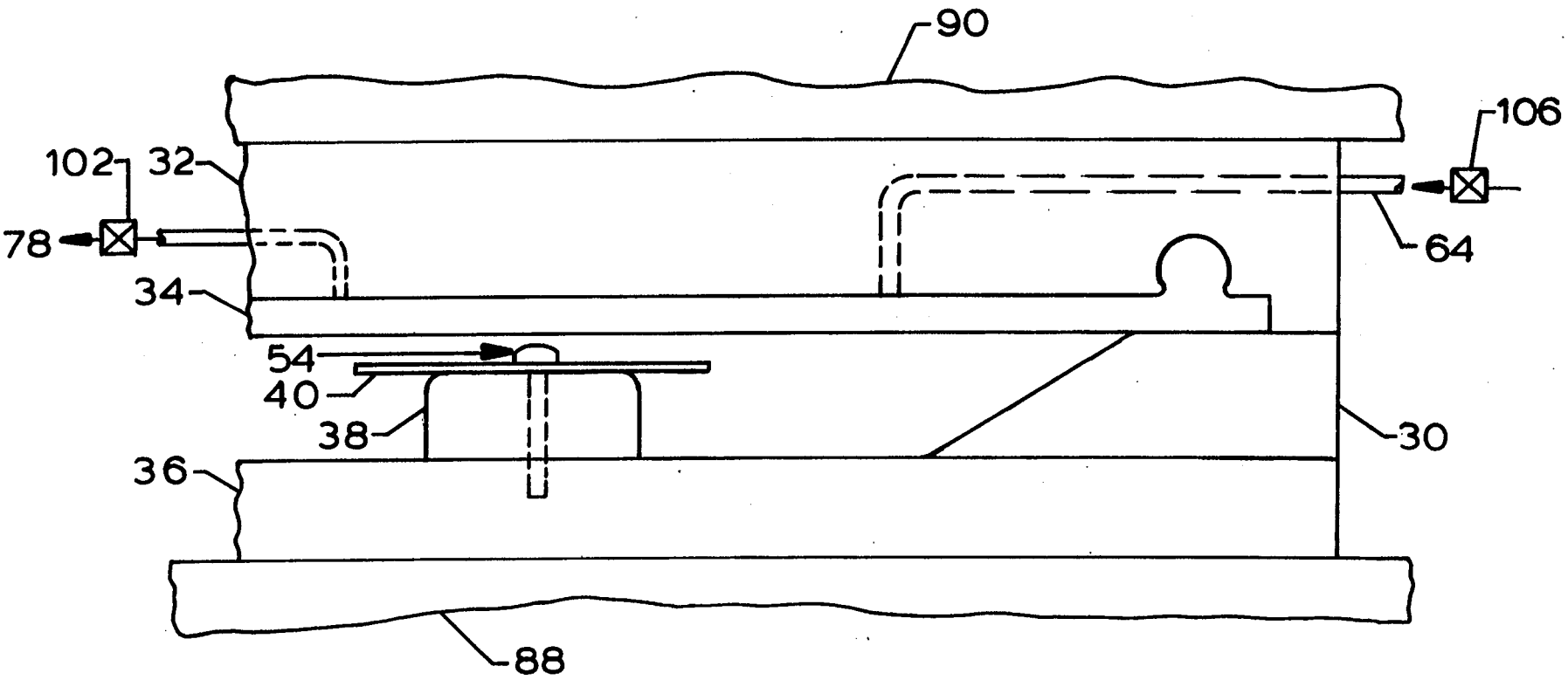
FIG. 5 illustrates the hydroform process as it indicates hydroform platens mounted to the press is such a manner that high pressure fluid from the hydraulic multiplier will cause the urethane bladder to deform sheet metal to the form block.

FIG. 5 is another example of versatility as we convert the apparatus to simulate hydroforming operations. A hydroform bladder platen 32 containing a prepoured bladder 34 is mounted to the platen 46. Form Block 38 is mounted to the attach platen 36 which is secured to the platen 48. Part 40 is secured to the form block 38 with a tool pin 54. Note that 38 is a bladder guide added to allow the bladder 34 to deform without tearing.

Figure 6:
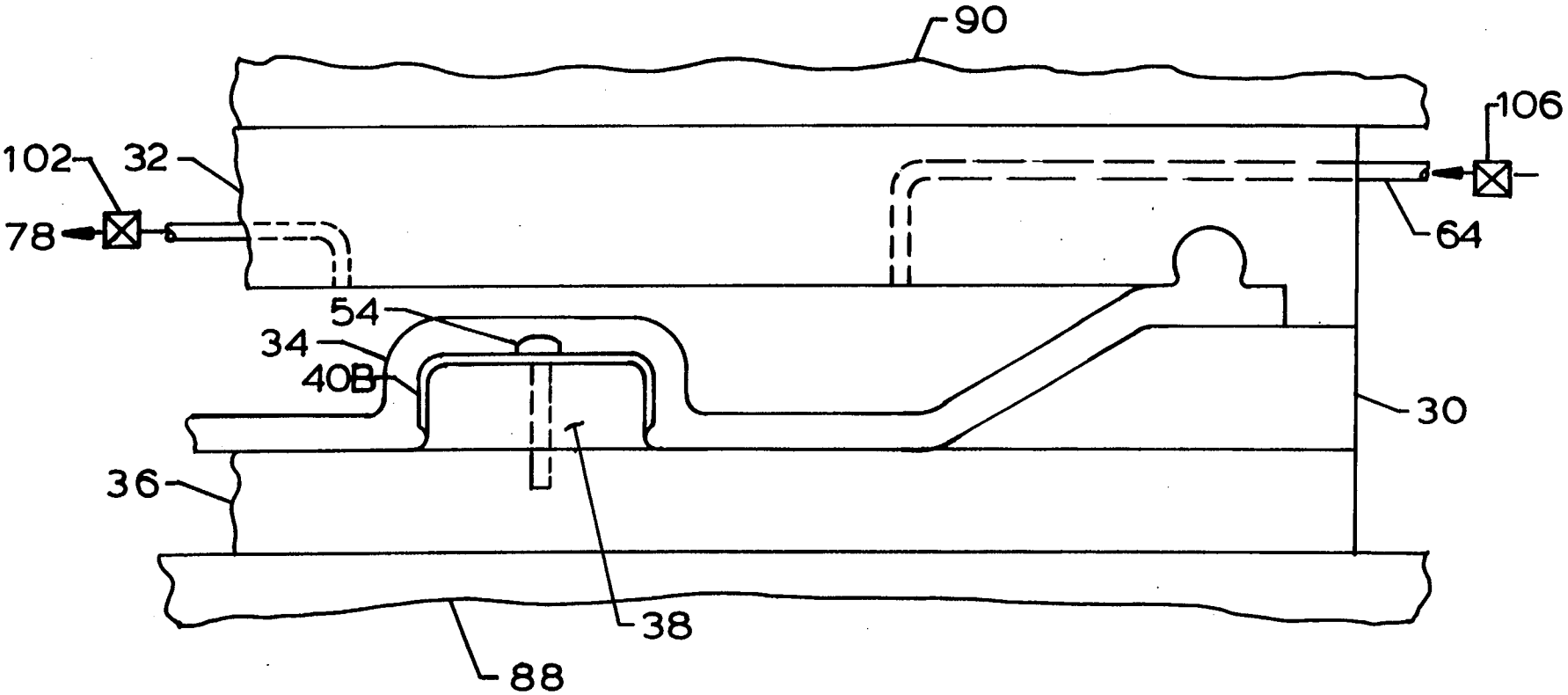
FIG. 6 is the same as FIG. 5 except it shows the sheet metal shape after forming.

FIG. 6 is the same as FIG. 5 except is shows 40B as the formed sheet metal shape with the bladder 34 in the deformed condition.

Figure 7:
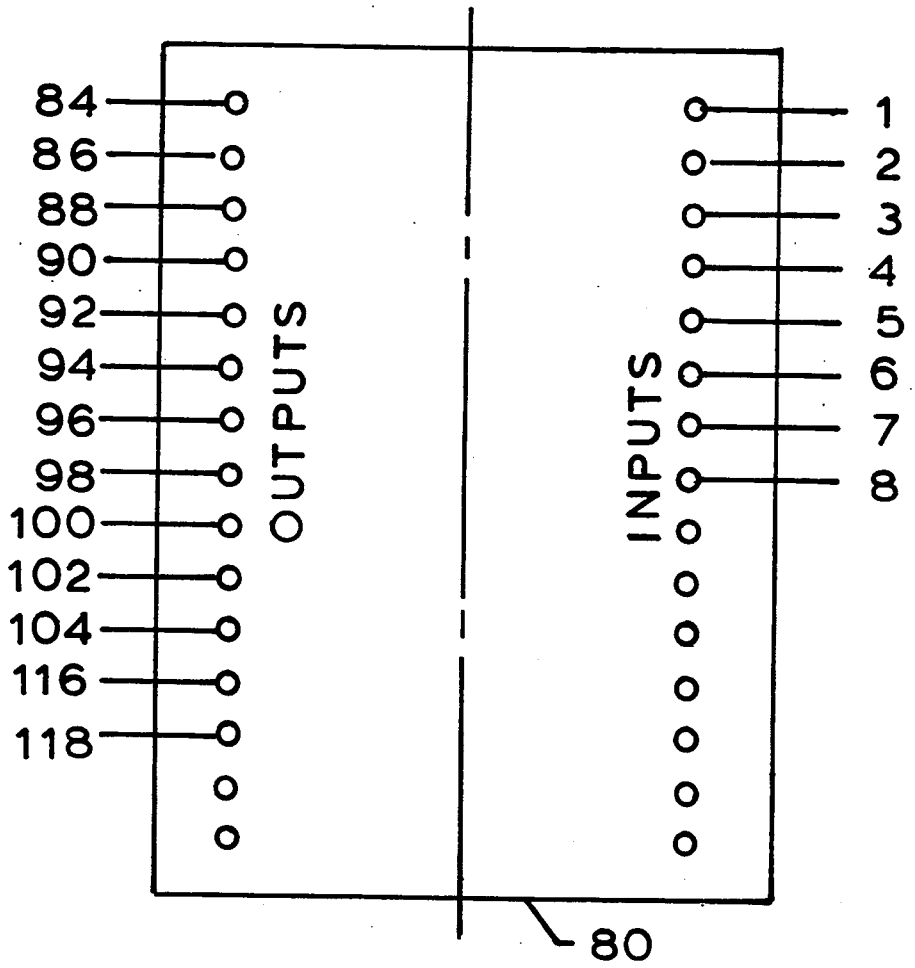
FIG. 7 is a diagram of the inputs and outputs that have been furnished to the controller. The control board 80 list 8 inputs which are spelled out and 13 outputs to valves which are noted.

FIG. 7 is a diagram of the inputs and outputs that have been funished to the controller. The control board 80 list 8 inputs which are spelled out and 13 outputs to valves which are noted. The valves 84, 86, 88, 90, 92, 94, 96, 98, 100, 102 and 104 are control valves. Valves 116 and 118 are priming valves.

Figure 8:
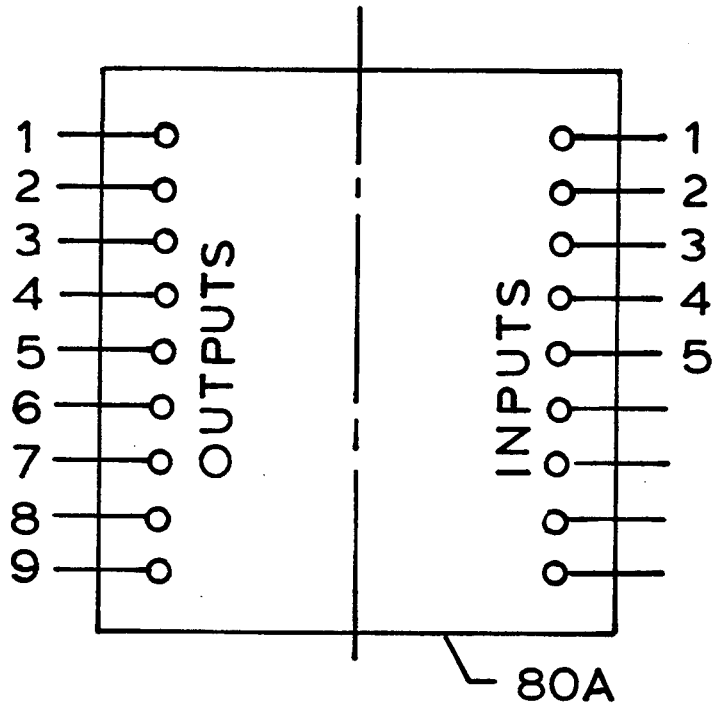
FIG. 8 is a diagram of the inputs and outputs necessary to position the structural slider 17. The sprockets immediately adjacent other structural slider are the positioning sprockets and the outermost sprockets are the locking sprockets.

FIG. 8 is a diagram of the inputs and outputs necessary to position the structural slider 17. The sprockets immediately adjacent to the structural slider 17 are the positioning sprockets 120 and 124 and the outmost sprockets 122 and 124 are the locking sprockets. The inputs and outputs are spelled out.

Figure 9:
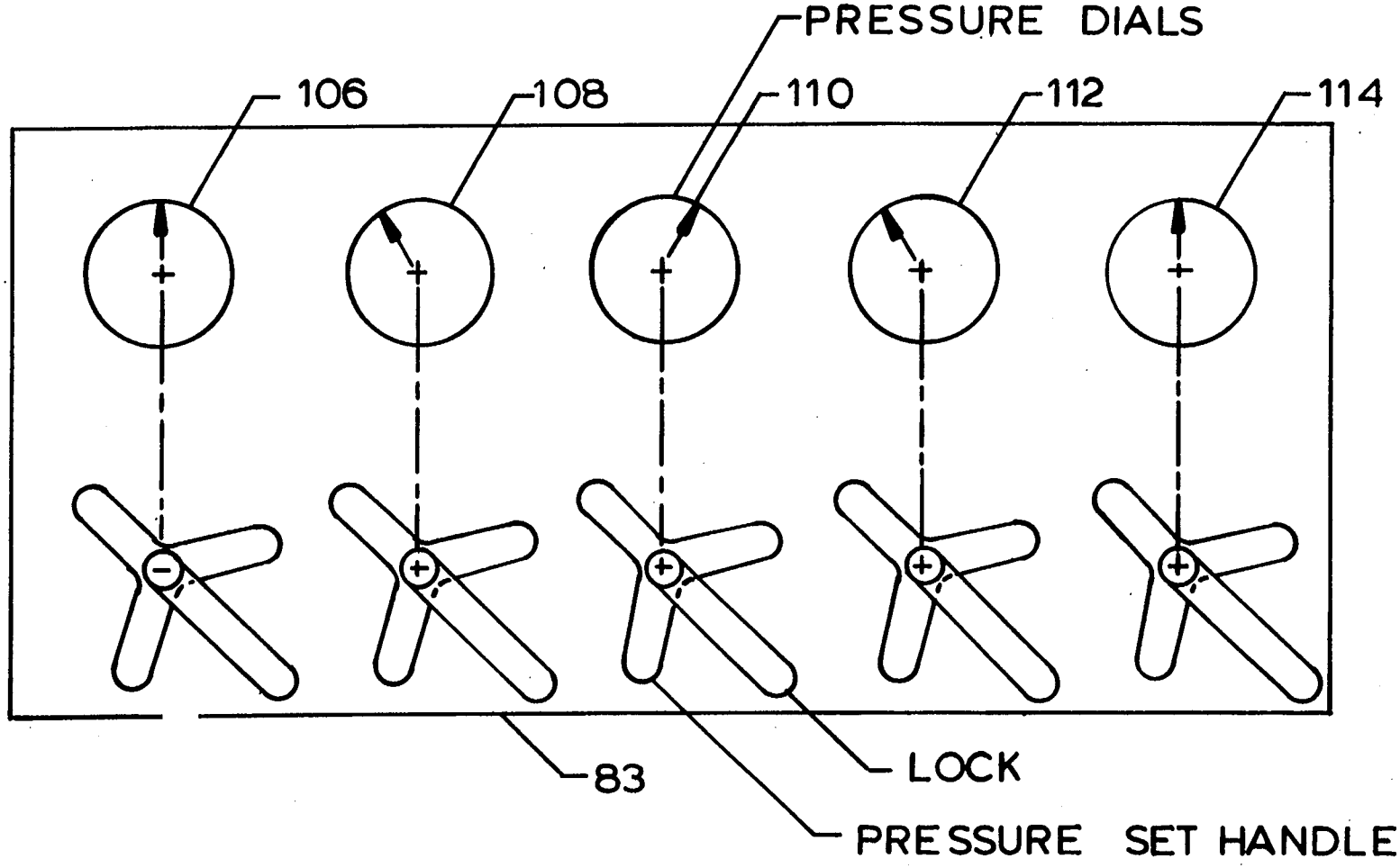
FIG. 9 is pressure control assembly in that the pressure relief valves are dialed in with pressure set handles and then locked in place.

FIG. 9 is pressure control assembly in that the pressure relief valves are dialed in with pressure set handles and then locked in place. Pressure relief valves 106, 108,

110, 112, and 114 are set and locked before operations are begun.

Accordingly the reader will see that a multitude of materials can be formed in this facility cost effectively in that Non-recurring cost of several machines is avoided by utilizing quick change platens to convert the press to one simulating and doing the work of a draw die press, a drop hammer press, a hydro press, a tube bender, and an internal bulge form press.

By designing a multi-purpose press, floor space is minimized.

By utilizing a main pump, augmented with auxiliary high and low pressure sources, to actuate a main drive cylinder that energizes a high pressure multiplier, all draw die operations can be programmed into the controller/recorder to cause a draw die platen mounted to the apparatus to apply pressure to a sheet metal blank and an o-ring while high pressure hydraulic fluid is pumped through the platen and onto the metal sheet forcing it to take the shape of the die mounted on the opposing platen.

The expense of dual dies, male and female, is eliminated as high pressure hydraulic fluid will replace one of them.

When the machine has been converted to a hydro press by installing the hydro platen, one or more form blocks can be mounted to the form block platen and the urethane bladder will be inflated with high pressure and expand, forcing the flat patterns to take the shape of the form blocks mounted on the opposing platen.

Piping or ducting is secured to one of the dies mounted to one of the piping platens. Preforming is accomplished by translating the dies together. Final forming is accomplished by pumping fluid into the piping and forcing it to take the shape of the mating dies.

Hydraulic fluid replaces rollers and snakes normally used to manipulate piping and form same. Adverse wrinkling and thinning is minimized.

There are a multitude of shapes that required half stampings hand welded together to form the desired shapes. This invention makes it possible to form the majority of these shapes form a rolled and automatic machine welded shape resulting in a superior product at a cost savings.

Although the description above contains many specificities, these should not be construed as limiting the scope of the invention but as merely providing illustration of some of the presently preferred embodiments of this invention.

Thus the scope of the invention should be determined by the appended claims and their legal equivalents, rather than by the examples given.

This apparatus has been designed to provide several services in a small area. As noted earlier this apparatus will be used to manipulate and form piping, simulate and improve upon the draw die process and to simulate and improve upon the hydroforming process. The following are the steps necessary to form the noted sheet metal shapes:

The key to the success or failure of this apparatus lies in the arrangement of the control valves, pressure relief valves and the input output to the controller/recorder. Quick disconnect panels can be changed to suit the operator. In this invention 2 quick disconnect panels are used. FIG. 7 illustrates inputs to control valves 84, 36, 88, 90, 92, 94, 96, 98, 100, 102, 104, and to priming valves 116 and 118. FIG. 8 illustrates inputs and outputs to the positioning sprockets 120 and 124 and to the locking sprockets 122 and 126. This controls the distance between platens. FIG. 9 illustrates pressure settings for the relief valves 106, 108, 110, 112, and 114. With a proper input output arrangement operations can be planned for a smooth efficient operation.

Piping:

(a) Die 50 is mounted to platen 46 and die 52 is mounted to platen 48. The distance between platens is determined and set with the position sprockets 120 and 124. The alignment is fed by a ball feed back to the quick change disconnect panel 80A. Pipe 58 with end plugs 54 is mounted in die 50. Gate 18 is closed. Fluid is pumped through the pipe 58 to evacuate air. With the pipe filled, the dies 50 and 52 are closed preforming the pipe 58. Final sizing is accomplished by delivering high pressure fluid to bulge the pipe 58 to the formed die shape 58B.

Draw Die:

(b) The apparatus can be converted to simulate the work of draw dies by mounting the draw die attach platen 20 to LH platen 48. Fluid pressure is delivered to the bladder 21 which inflates and causes the pressure plate 22 to apply appropriate pressure to the sheet metal blank 28 and the o-ring 26. Resisting the pressure is the blank 28 and the draw die 24 which is mounted to a draw die platen 23 which is mounted to RH platen 46. High pressure can now be delivered from the high pressure multiplier 74 through pressure platen 22 to cause the blank 28 to take the shape of the die 24. The high pressure delivery is a high speed operation. The operations noted are defined by FIGS. 3 and 4.

Hydroforming:

(c) The apparatus can be converted to simulate the work of an expensive hydropress by mounting the hydropress platen 32 which contains the bladder 34 to platen 48. The form block mounted platen 36, containing form block 38 and flat pattern 40 aligned to the form block with a tool pin 54, is mounted to platen 46. High pressure can then be delivered to and through the platen 32 to cause the urethane bladder 34 to inflate and form the sheet metal shape 40B. Bladder guide 30 is added to prevent tearing of the bladder 34. The operations noted are defined by FIGS. 5 and 6.

I claim:

1. Apparatus for high pressure hydraulic forming of sheet metal blanks, flat patterns, and piping comprising:

a basic support structure having a top surface and a bottom surface;

a right hand (RH) sliding mount platen having a front surface and a rear surface;

a left hand (LH) sliding mount platen having a front surface and a rear surface;

means for mounting said sliding mount platens on said basic support structure with their front surfaces facing each other;

a main pump reservoir having a hydraulic fluid connection to a main pump, said main pump having a hydraulic fluid connection to a hydraulic manifold;

a left hand (LH) hydraulic drive cylinder connected to the rear surface of said left hand (LH) sliding mount platen of reciprocally transporting said left hand (LH) sliding mount platen toward and away from said right hand (RH) sliding mount platen, said left hand (LH) hydraulic drive cylinder being connected to said hydraulic manifold;

a right hand (RH) hydraulic drive cylinder connected to the rear surface of said right hand (RH) sliding mount platen for reciprocally transporting said right hand (RH) sliding mount platen toward and away form said left hand (LH) sliding mount platen, said RH hydraulic drive cylinder being connected to said hydraulic manifold;

a main drive hydraulic cylinder having a high pressure multiplier output, said main drive hydraulic cylinder having an input connection from said hydraulic manifold and an output connection to said hydraulic manifold;

a primary piping die and a piping mount removably secured to the front surface of said right hand (RH) sliding mount platen;

an opposing piping die removably secured to the front surface of said left hand (LH) sliding mount platen;

a die draw assembly that is interchangeably mounted on said respective right hand (RH) and left hand (LH) sliding mount platens and means for detachably connecting said draw die assembly to said hydraulic manifold so that a draw die blank can be formed into a draw die formed shape; and a hydro-forming die assembly that is interchangeably mountable on said respective right hand (RH) and left (LH) sliding mount platens and means for detachably connecting said hydro-forming die assembly to said hydraulic manifold so that a flat sheet metal pattern can be formed into a predetermined sheet metal shape.

2. Apparatus as recited in claim 1 further comprising piping end plug center feed means detachably connectable to a pipe shaped workpiece and means for supplying pressurized hydraulic fluid to its interior.

3. Apparatus as recited in claim 1 further comprising a left hand (LH) overcenter linkage secured to the rear surface of said left hand (LH) sliding mount platen and a right hand (RH) overcenter linkage secured to the rear surface of said right hand (RH) sliding mount platen.

4. Apparatus as recited in claim 1 further comprising a hydraulic drain sump formed in said basic support structure.

5. Apparatus as recited in claim 4 further comprising a low pressure pump that has a hydraulic fluid connection to said hydraulic drain sump and a hydraulic fluid connection to said high pressure multiplexer.

* * * * *